United States Patent [19]

Rosenthal

[11] Patent Number: 4,995,746

[45] Date of Patent: Feb. 26, 1991

[54] OFFICE MACHINE

[75] Inventor: Manfred Rosenthal, Kirchen-Freusburg, Fed. Rep. of Germany

[73] Assignee: U.S. Philips Corporation, New York, N.Y.

[21] Appl. No.: 317,378

[22] Filed: Mar. 1, 1989

[30] Foreign Application Priority Data

Mar. 10, 1988 [DE] Fed. Rep. of Germany ..... 3807809

[51] Int. Cl.[5] ..... B41J 11/32

[52] U.S. Cl. ..... 400/616.2; 400/636; 400/637

[58] Field of Search ..... 400/616.2, 616, 605, 400/617, 616.1, 636, 637

[56] References Cited

U.S. PATENT DOCUMENTS

| | | | |
|---|---|---|---|
| 3,644,930 | 2/1972 | Stange et al. | 400/617 |
| 4,360,279 | 11/1982 | Sugiura | 400/605 |
| 4,413,704 | 11/1983 | Weber et al. | 400/616.1 |
| 4,475,833 | 10/1984 | Sawicki | 400/605 |
| 4,564,305 | 1/1986 | Rekewitz et al. | 400/616.1 |
| 4,571,103 | 2/1986 | Takeo et al. | 400/616.1 |
| 4,663,722 | 5/1987 | Sato | 400/605 |
| 4,688,957 | 8/1987 | Preuignano | 400/605 |
| 4,806,036 | 2/1989 | Ward et al. | 400/605 |
| 4,934,849 | 6/1990 | Yosuoka | 400/616 |

FOREIGN PATENT DOCUMENTS

| | | | |
|---|---|---|---|
| 0071713 | 2/1983 | European Pat. Off. | 400/617 |
| 0197340 | 10/1986 | European Pat. Off. . | |
| 0266139 | 4/1988 | European Pat. Off. . | |
| 0185670 | 10/1984 | Japan | 400/605 |
| 0161175 | 8/1985 | Japan | 400/616.2 |
| 0172567 | 9/1985 | Japan | 400/616.2 |
| 0097871 | 5/1987 | Japan | 400/616 |
| 0134280 | 6/1987 | Japan | 400/605 |
| 0233275 | 10/1987 | Japan | 400/616.3 |
| 2197737A | 11/1987 | United Kingdom | 400/605 |

OTHER PUBLICATIONS

Webster's New World Dictionary, Third College Edition.

*Primary Examiner*—Edgar S. Burr
*Assistant Examiner*—John S. Hilten
*Attorney, Agent, or Firm*—William Squire

[57] ABSTRACT

In an office machine, for example a printer, with a printing unit, with individual paper transport via pairs of rollers and with endless paper transport via a tractor, a release of the pressure rollers, which is necessary for the tractor to operate in the pulling mode, is carried out by means of two stops attached to the tractor, the pressure roller of a first pair of roller being released via the first stop, during the pivoting of the tractor up into the pulling position, and the pressure roller of a second pair of roller being released, in the pulling position of the tractor, during the inward pivoting of a pivoting housing part, on which the pressure roller of the second pair of rollers are arranged resiliently.

10 Claims, 3 Drawing Sheets

OFFICE MACHINE

The invention relates to an office machine with a printing unit, with individual paper transport via a first pair of rollers located in front of the printing unit and a second pair of rollers located behind the latter, and with endless paper transport via a tractor.

Of interest are copending applications Ser. No. 317,376 entitled "Office Machine" filed concurrently herewith by the present inventor and Ser. No. 321,620 filed Mar. 9, 1989 by Durr et al entitled "Office Machine", both being assigned to the assignee of the present invention.

An office machine of this type, designed as a printer, became known, for example, from EP 0,197,340 A2. The known printer possesses a pair of rollers, respectively in front of and behind the printing unit in the direction of run of the paper and comprising in each case a driving roller and a pressure roller. Furthermore, a tractor is provided for the transport of endless paper, which has essentially a straight paper running track, the tractor working in the pushing mode. For this, the pressure rollers located in front of the printing unit and belonging to one pair of rollers are opened. For individual paper transport, the tractor is pivoted so that now individual sheets can be guided via the two pairs of rollers, both pressure rollers being pressed against the corresponding driving rollers.

The object on which the invention is based is to design an office machine of the type mentioned in the introduction, in such a way that the pressure rollers belonging to the pairs of rollers and no longer required when the tractor is changed over from the pushing mode to the pulling mode can be opened or released from their driving rollers in a simple way. This object is achieved because the tractor is pivotable from a pushing position into a pulling position and has two stops, because during the pivoting of the tractor into the pulling position, the pressure rollers of the first pair of rollers are releasable as a result of the action of the first stop and because the pressure rollers arranged on a pivoting housing part and belonging to the second pair of rollers are releasable, during the closing of the pivoting housing part, by means of the second stop projecting in the pulling position. As a result of the device according to the invention, the pressure rollers are automatically released from their respective driving rollers as a result of simple adjustment of the tractor, so that now the path for the endless paper to be processed in the pulling position can no longer be blocked by the pressure rollers. The automatic opening takes place by means of two stops, of which the first acts on the first pair of rollers during the pivoting of the tractor and the second acts on the second pair of rollers after the completed pivoting of the tractor, each with the effect of opening or release of the paper path from the respective driving rollers.

In an embodiment of the invention, the first stop acts on a lever mechanism with a rod which, at its one end, is connected to the pressure rollers of the first pair of rollers via a one-armed rotary lever, in such a way that the pressure rollers are opened or closed during a longitudinal movement, and which, at its other end, is connected in an articulated manner to one lever arm of a two-armed rotary lever, the free lever arm of which has a curved engagement surface for the engagement of the first tractor stop. The engagement of the first stop over the curved engagement surface causes a uniform and reliable actuation of the lever mechanism. Preferably, in a further embodiment, at one end of the rod the one-armed rotary lever has a flattened rotary shaft, against which a blade spring rests under pressure, the free end of the blade spring acting on the mounting of the pressure rollers in such a way that they are opened when the blade spring rests against the circular circumference of the rotary shaft and are pressed down when it rests against the flattened part. An automatic return to the initial position takes place because, in the pushing position of the tractor, the rod of the lever mechanism is pulled into its initial position by a spring.

A simple opening of the pressure rollers of the second pair of rollers is obtained by arranging these pressure rollers are resiliently on a carrier which, in the pushing position of the tractor, is designed as a paper guide unit and which is itself mounted rotatably on the pivoting housing part, and which, when the pivoting housing part is opened, is pressed against a projection of the pivoting housing part via a tension spring. The pivoting housing part is mounted pivotably in side walls of the housing of the office machine and, in the opened, swung-up state, allows complete access to the tractor. The separate arrangement of the pressure rollers on a carrier, itself mounted rotatably on the pivoting part, opens the pressure rollers during the closing of the pivoting housing part into the path of movement of the latter. The position of the carrier serving as paper guide unit can thus be varied at the same time. In a further embodiment of the invention, a reliable opening of the pressure rollers in this way is obtained because, when the pivoting housing part is closed and the tractor is in the pulling position, the carrier together with the pressure rollers is deflected by the second stop counter to the force of the tension spring, so that the pressure rollers are lifted and the paper guide unit is adjusted. The pressure rollers of the second pair of rollers can be mounted on a guide flap of the paper guide unit resiliently, for example by means of a blade spring, in order to obtain a uniform pressure in the closed state.

A printer as an exemplary embodiment of the invention is illustrated diagrammatically in FIGS. 1 and 2 of the drawing. The drawings show respective side views of the printer, with a tractor illustrated in two different positions within the printer. Only the parts of the printer which are essential to the invention are shown in each case.

Figure 1:
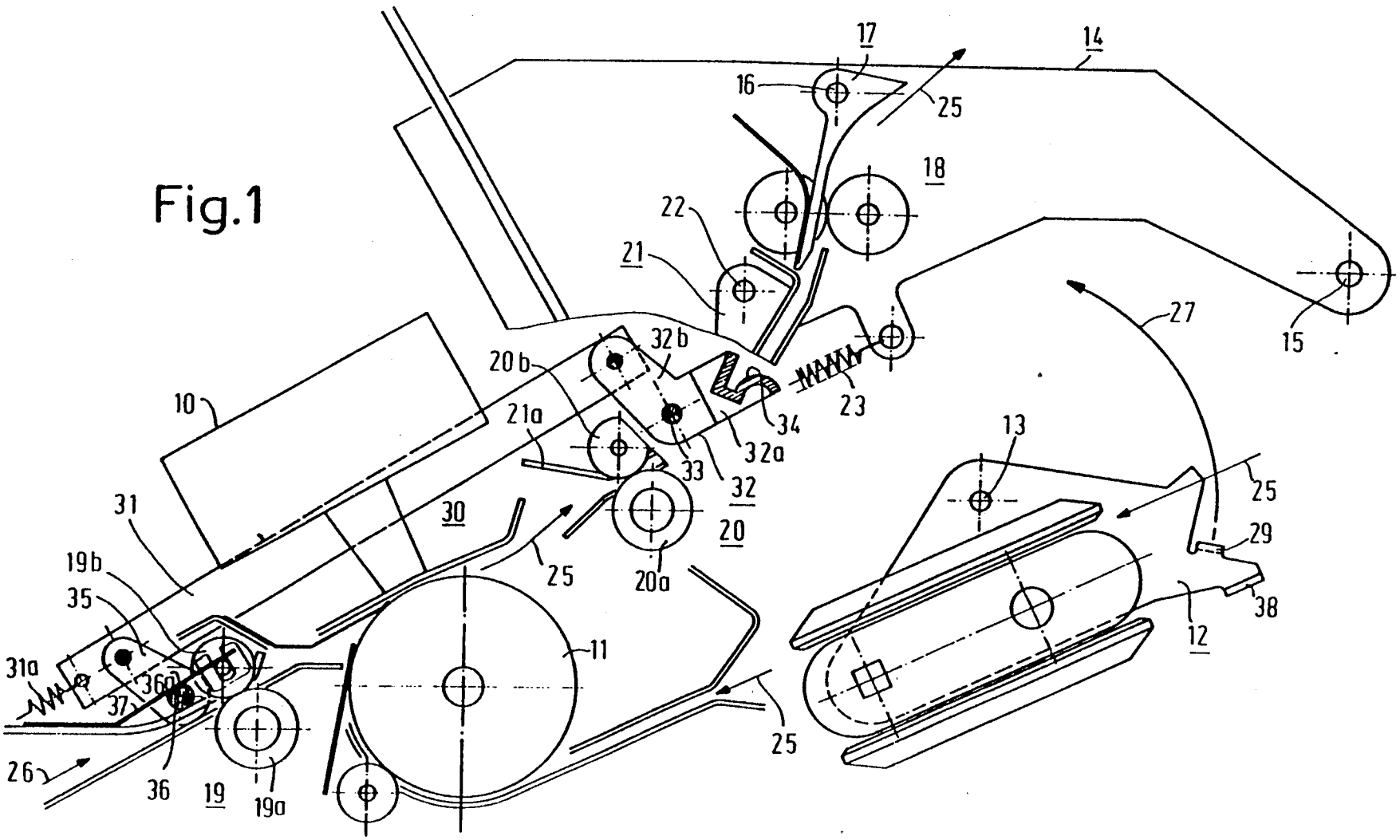
FIG. 1 shows the printer in a pushing position of the tractor.
Figure 2:
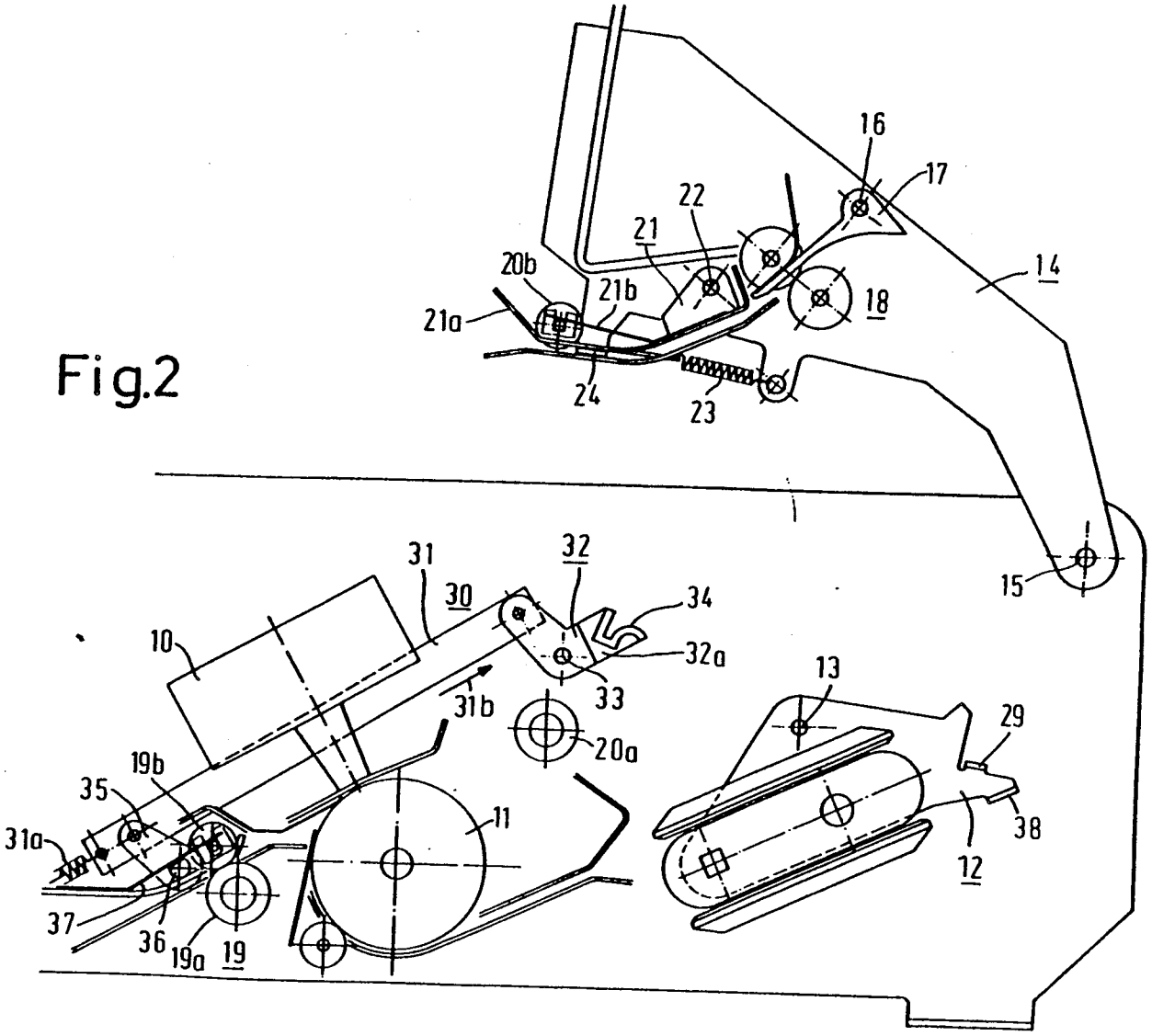
FIG. 2 shows the printer in a position according to FIG. 1, but with a pivoting housing part swung up.

The printer possesses as a central component a printing unit 10 with a printing roller 11 mounted in the side walls of the housing (FIG. 2). A tractor 12 for the transport of endless paper is mounted rotatably to the housing walls (only one being shown) via pegs 13 (FIG. 3) and can assume two lockable end positions. The first position is the pushing position according to FIGS. 1 and 2 and the second the pulling position according to FIG. 3. A pivoting housing part 14 is rotatable at the centre of rotation 15 and which, when swung up, as shown in FIG. 2 allows easier access to the tractor 12. The pivoting part 14 carries an adjustable switch 17 rotatable at pivot 16. This adjustable switch serves, together with a pair of rollers 18, for the deflection of individual paper or endless paper which is conveyed from the printing unit 10.

19 Denotes a pair of rollers 19*a* and 19*b* are located in front of the printing unit 10 and 20 denotes a pair of rollers 20*a* and 20*b* located behind the printing unit 10, 19*a*, 20*a* being the driving rollers and 19*b*, 20*b* the pressure roller. The pressure roller 20*b* rests on a paper guide carrier 21 which is designed as a paper guide unit having an upper flap 21*a* and is mounted rotatably in the pivoting part 14 via pivot 22 in the swung-up state of the pivoting part 14, roller 20*b* is pressed against a projection 24 of the pivoting part 14 by a tension spring 23.

In the pushing position according to FIG. 1, endless paper 25 is fed through the tractor 12 from the rear. The endless paper 25 runs over the printing roller 11, is thereby curved and is conveyed on upwards via the pair of rollers 20*a* and 20*b*, the paper guide unit 21 and the pair of rollers 18. In this operating position, all the driving rollers of the pairs of rollers 18, 19, 20 are operative, with the pressure rollers pressed down. In this position of the tractor 12 individual papers 26 can also be guided via the pairs of rollers 19, 20 and 18, when the tractor 12 for conveying the endless paper 25 is inoperative.

Figure 3:
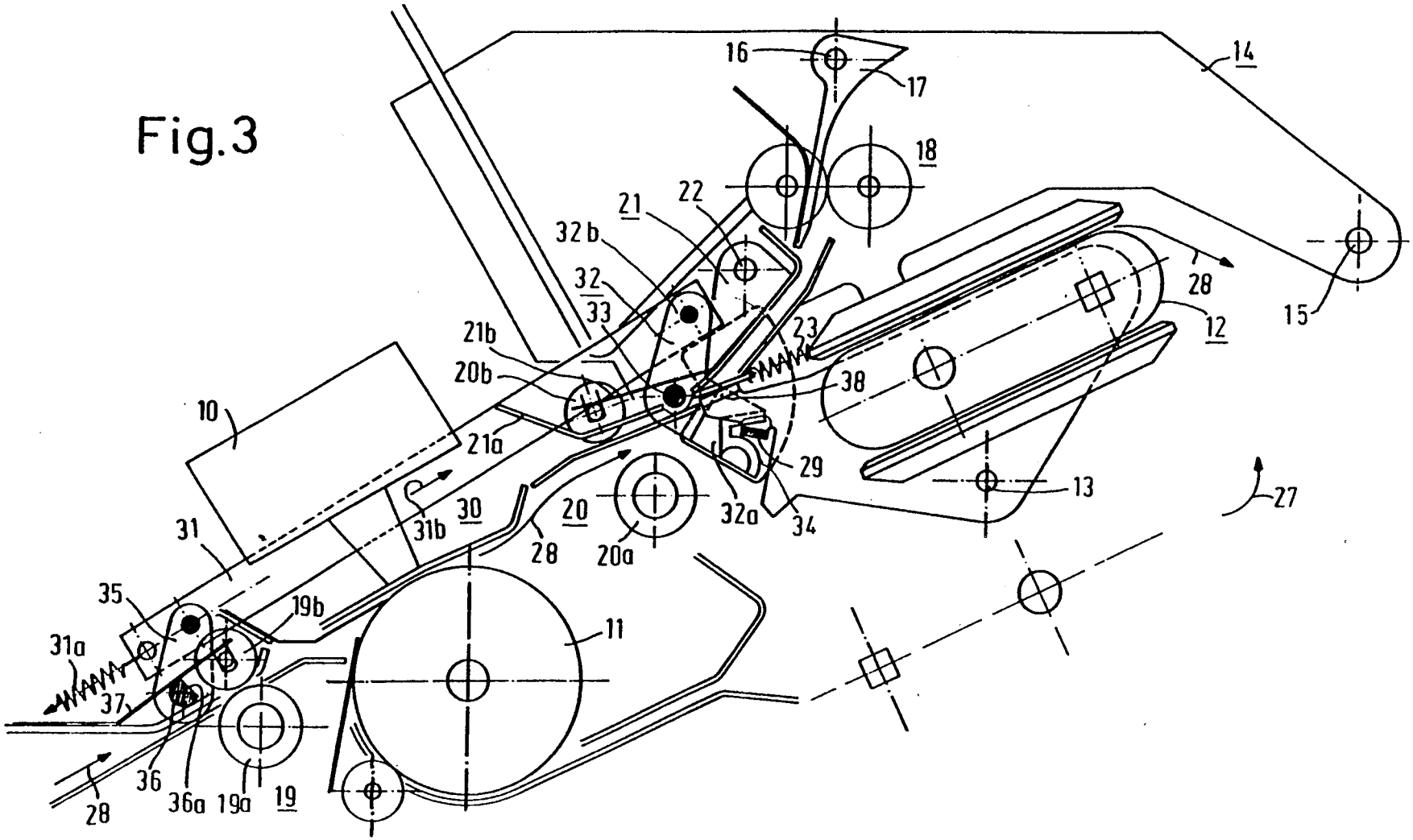
FIG. 3 shows the printer in a pulling position of the tractor.

According to FIG. 3, the tractor 12 is placed in its pulling position after pivoting in the direction 27. In this position, the endless paper 28 fed from the front is pulled by the tractor 12 and leaves the printer at its rear. For this, the pressure rollers 19*b*, 20*b* must be opened, that is to say released from the respective driving rollers 19*a*, 20*a*, so that the pulling movement of the tractor is not impeded. The pressure rollers 19*b* are released because, during the pivoting up of the tractor 12, a first stop 29 of the tractor 12 acts on the pressure rollers 19*b* via a lever mechanism 30. For this purpose, in FIG. 2, a rod 31 is connected in an articulated manner, at one end, to a two-armed crank lever 32 pivotally mounted to the housing via pivot 33. A curved engagement surface 34 is on arm 32*a* for for engaging stop 29. During the pivoting of the tractor 12 in the direction 27, the stop 29 slides on the surface 34, so that the rod 31 is deflected in the direction 31*b* counter to the force of a spring 31*a*. A one-armed lever 35 mounted to the housing via a flattened shaft 36 is thereby moved. During the rotation of the lever 35, a blade spring 37 rests either against the circular circumference or against the flattened portion 36*a* (FIG. 3). According to FIGS. 1 and 2, the blade spring 37 rests against the flattened portion 36*a* and thus presses the pressure roller 19*b* against the driving roller 19*a*. According to FIG. 3, the blade spring 37 is lifted as a result of the rotation of the lever 35, so that the pressure roller 19*b* is released.

The release of the pressure roller 20*b* located behind the printing unit 10 from the associated driving roller 20*a* takes place because first, with the pivoting housing part 14 swung up (FIG. 2), the tractor 12 is shifted in the direction 27 into the pulling position according to FIG. 3. At the same time, a second stop 38 attached to the tractor 12 is brought into the path of movement of the pivoting part 14, in such a way that, when the latter swings down, the paper guide unit 21 rotatable at pivot 22 on the pivoting part 14 is lifted, together with the pressure rollers 20*b* fastened to it, by this stop 38, with the result that the pressure roller 20*b* is also released from the driving roller 20*a*. This also at the same time opens the way for the transport of the endless paper 28, since the paper guide unit 21 is pivoted out of the path of the endless paper 28 as a result of the rotational movement.

Thus, in the design according to the invention, a simple embodiment of the tractor with two cleverly arranged stops ensures that the pressure rollers necessary in the pushing position of the tractor can be released simply by pivoting the tractor up into the pulling position. At the same time, a paper guide device can therefore be moved out of the region of the paper run in the pulling mode. The release of the pressure rollers on the one hand and, if appropriate, the change of the paper guide thus take place automatically as a result of the adjustment of the tractor, without any additional components having to be added or removed. This is achieved solely as a result of a skillful and carefully planned interaction between the stops of the tractor and the mechanisms controlling the positions of the pressure rollers.

I claim:

1. Office machine comprising:

a housing including a pivoting housing part having open and closed states;

a printing unit secured to the housing;

individual paper transport means comprising a first pair of rollers including a first pressure roller in front of the printing unit and a second pair of rollers including a second pressure roller behind the printing unit along a paper path, said pressure rollers having release and pressure modes, the pressure roller of the second pair being secured to the pivoting housing part;

a tractor for endless paper transport, the tractor being pivotally secured to the housing for pivoting to paper pulling and pushing positions;

first and second stops secured to the tractor; and roller release means secured to the housing for engaging the stops with the tractor in said pulling position so that the first pressure roller is released in response to engagement with said first stop and the second pressure roller is released in response to the engagement of the second stop with said housing part in the closed state.

2. The Office machine of claim 1 wherein said roller release means includes a lever mechanism comprising a rod which, at one end thereof, is connected to the first pressure roller via a one-armed rotary lever, and which, at the other rod end is connected in an articulated manner to one lever arm of a two-armed rotary lever, the other lever arm of which has a curved engagement surface for engagement with the first tractor stop such that longitudinal movement of the rod in response to rotation of the two-arm lever rotates the one-arm lever to place the first pressure roller in the release and pressure modes.

3. The office machine of claim 2 wherein the one-armed rotary lever includes a circular rotary shaft a portion of the circumference of the shaft being flattened, a blade spring abutting the shaft under pressure and coupled to the first pressure roller so that when the spring abuts said circular portion of the shaft the first roller is in the release mode and when the spring abuts said flattened portion, the first roller is in the pressure mode.

4. The office machine of claims 2 or 3 including spring means coupled to said lever mechanism for resiliently loading the mechanism during engagement of the curved surface with the first stop.

5. The office machine of claim 1 including means defining a paper path, a carrier rotatably secured to the housing part and including means adapted to guide paper located in the paper path in the pushing position of the tractor, means for resiliently coupling the second pressure roller to the carrier, said housing part including a projection, said second pressure roller being located so as to be resiliently pressed against said projection in the open state of the housing part.

6. The office machine of claim 5 wherein said carrier and second pressure roller are arranged such that in response to the engagement of the second stop with said housing part in the closed state, the second roller is resiliently released from the other roller of the second pair and said means adapted to guide paper is displaced from the paper path.

7. The office machine of claim 5 or 6 wherein the means adapted to guide paper includes a paper guide having upper and lower guide flaps, said second pressure roller being resiliently coupled to said lower flap.

8. Printer apparatus with endless and sheet paper feed modes comprising:

a housing;

a printing unit secured to the housing;

sheet paper transport means comprising a first pair of rollers rotatably secured to the housing in front of the unit and a second pair of rollers rotatably secured to the housing behind the unit relative to a paper print feed path, each said pairs having a pressure applying mode for feeding said sheet paper and a release mode during feed of said endless paper;

an endless paper feed tractor pivotally secured to said housing for pivoting to a paper pull position and a paper push position; and means coupled to said tractor, said housing and at least one roller of said first pair and one roller of said second pair for selectively placing said rollers in the release mode in response to the placement of the tractor in one of said pull and push positions and in the pressure mode in response to the placement of the tractor in the other of said pull and push positions.

9. The apparatus of claim 8 wherein said means coupled to the tractor, housing and at least one roller includes stop means secured to said tractor, lever means secured to the housing responsive to said stop means for selectively placing one of said at least one roller in said release and pressure modes and pivotable housing part means engageable with said stop means for selectively placing the other of said at least one roller in said release and pressure modes in accordance with the pivot position of the housing part means, both the one and other of said at least one roller being placed in the same position of said release and pressure positions in accordance with a given position of the tractor.

10. Printer apparatus with endless and sheet paper feed modes comprising:

a housing;

a printing unit secured to the housing;

sheet paper transport means comprising a first pair of rollers rotatably secured to the housing in front of the unit and a second pair of rollers rotatably secured to the housing behind the unit relative to a paper print feed path, each said pairs having a pressure applying mode for feeding said sheet paper and a release mode during feed of said endless paper;

an endless paper feed tractor pivotally secured to said housing for pivoting to a paper pull position and a paper push position; and means coupled to said tractor, housing and at least one roller of each said pair for selectively placing said rollers in the release mode in response to the placement of the tractor in one of said pull and push positions and in the pressure mode in response to the placement of the tractor in the other of said pull and push positions;

said means for selectively placing including first and second stops secured to said tractor, lever means coupled to the at least one roller of one of said pairs, a housing part pivotally secured to said housing and having open and closed states, the at least one roller of the other of said pairs being rotatably secured to said housing part, said housing part including a third stop, one of said first and second stops engaging said lever means when said tractor is in said pull position for releasing the at least one roller of said one of said pairs, said third stop engaging the other of said first and second stops when said tractor is in said pull position and said housing part is in the closed state.

* * * * *